US011598063B2

(12) United States Patent
Barnes

(10) Patent No.: US 11,598,063 B2
(45) Date of Patent: Mar. 7, 2023

(54) PILE GUIDE AND ADJUSTABLE MOUNTING

(71) Applicant: Sean A. Barnes, Mt. Pleasant, SC (US)

(72) Inventor: Sean A. Barnes, Mt. Pleasant, SC (US)

( * ) Notice: Subject to any disclaimer, the term of this patent is extended or adjusted under 35 U.S.C. 154(b) by 0 days.

(21) Appl. No.: 17/577,661

(22) Filed: Jan. 18, 2022

(65) Prior Publication Data

US 2022/0136201 A1 May 5, 2022

Related U.S. Application Data

(63) Continuation-in-part of application No. 17/215,917, filed on Mar. 29, 2021, and a continuation-in-part of application No. 16/830,343, filed on Mar. 26, 2020.

(51) Int. Cl.

| | |
|---|---|
| ***E02B 3/06*** | (2006.01) |
| ***E02D 13/04*** | (2006.01) |
| *E02D 5/54* | (2006.01) |

(52) U.S. Cl.

CPC ..... *E02B 3/064* (2013.01); *E02D 13/04* (2013.01); *E02D 5/54* (2013.01); *E02D 2200/11* (2013.01); *E02D 2600/20* (2013.01)

(58) Field of Classification Search

CPC ..... E02D 13/04; E02B 13/06; E02B 13/062; E02B 13/064; E02B 13/066; E02B 13/068; B63C 1/02

USPC ..... 405/218–221

See application file for complete search history.

(56) References Cited

U.S. PATENT DOCUMENTS

| | | | |
|---|---|---|---|
| 3,074,239 | A | 1/1963 | Mustard |
| 3,270,698 | A | 9/1966 | Fort |
| RE27,090 | E | 3/1971 | Rutter |
| 3,603,276 | A | 9/1971 | De Lisle |
| 3,727,415 | A | 4/1973 | Williams |
| 3,967,570 | A | 7/1976 | Bradfield |
| 4,018,179 | A | 4/1977 | Rutter |
| 4,072,119 | A | 2/1978 | Williams |
| 4,276,849 | A | 7/1981 | Bloxham |

(Continued)

FOREIGN PATENT DOCUMENTS

| | | | |
|---|---|---|---|
| AU | 2006272839 A1 * | 3/2008 | ..... C07D 501/36 |
| DE | 2042850 | 3/1972 | |

(Continued)

OTHER PUBLICATIONS https://www.jetdock.com (excerpt printed Jan. 29, 2020).

(Continued)

*Primary Examiner* — Frederick L Lagman

(74) *Attorney, Agent, or Firm* — B. Craig Killough

(57) ABSTRACT

A pile guide has a collar with a void therein. A planar flange extends from a side of the collar. A first guide and a second guide form opposing guides constructed and arranged for receiving the planar flange of the pile guide therein. The planar flange is in a slidable relationship within the opposing guides, and the bracket is constructed and arranged for mounting to a dock. The opposing guides pivot relative to the dock during installation and allow pivoting of the pile guide relative to the dock or other mounting. The distance and angle of the collar relative to the dock or other mounting can be adjusted to accommodate for positioning of pile guides due to positioning of piles relative to a dock or other structure.

8 Claims, 8 Drawing Sheets

(56) References Cited

U.S. PATENT DOCUMENTS

| | | | | |
|---|---|---|---|---|
| 4,280,429 | A | 7/1981 | Wells | |
| 4,510,877 | A | 4/1985 | Bloxham | |
| 4,641,595 | A | 2/1987 | Pritchett | |
| 4,740,108 | A * | 4/1988 | Levee | E02B 3/068 405/196 |
| 4,763,592 | A | 8/1988 | Russ | |
| 4,782,778 | A | 11/1988 | Barbaglia | |
| 5,002,000 | A | 3/1991 | Rutter | |
| 5,016,551 | A | 5/1991 | Peck et al. | |
| 5,046,897 | A | 9/1991 | Ray | |
| 5,140,922 | A | 8/1992 | Bowman et al. | |
| 5,394,814 | A | 3/1995 | Rutter et al. | |
| 5,549,070 | A | 8/1996 | Cruchelow et al. | |
| 5,664,513 | A | 9/1997 | Echelbarger | |
| 5,826,528 | A | 10/1998 | Jancsek | |
| 5,860,379 | A | 1/1999 | Moody | |
| 5,860,765 | A | 1/1999 | Cruchelow et al. | |
| 6,145,463 | A | 11/2000 | Zeilinger | |
| 6,179,525 | B1 | 1/2001 | Gruhn et al. | |
| 6,477,968 | B2 | 11/2002 | Powell | |
| 6,526,902 | B1 | 3/2003 | Faber | |
| 6,547,485 | B2 | 4/2003 | Enon | |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 8,267,621 | B1 | 9/2012 | Way | |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 | 4/2019 | Barnes et al. | |
| 10,370,073 | B2 | 8/2019 | Barnes | |
| 10,822,063 | B1 | 11/2020 | Barnes | |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffee et al. | |
| 2007/0248420 | A1 | 10/2007 | Jacobs et al. | |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2014/0010593 | A1 | 1/2014 | Davis | |
| 2020/0115867 | A1* | 4/2020 | Kirby | E02B 3/064 |
| 2020/0370261 | A1 | 11/2020 | Barnes | |
| 2021/0039761 | A1 | 2/2021 | Barnes | |
| 2021/0214059 | A1 | 7/2021 | Barnes | |

FOREIGN PATENT DOCUMENTS

| | | |
|---|---|---|
| FR | 3017595 | 6/2014 |
| WO | WO2014035026 | 3/2014 |

OTHER PUBLICATIONS

Shoremaster, LLC, Official RhinoHoist Front Mount Floating Boat Life Video, YouTube, May 10, 2013, https://www.youtube.com/watch?v-ayxgoTHCijl.

* cited by examiner

PILE GUIDE AND ADJUSTABLE MOUNTING

BACKGROUND OF THE INVENTION

Floating docks are used to provide dockage for vessels. Floating docks accommodate for changes in water levels by floating in water. Piles driven into the earth are used to hold the dock in horizontal position. Pile guides are affixed to the dock that allow vertical movement of the dock but prevent substantial horizontal movement of the dock.

Piles are typically not driven with precision. There is a need for a pile guide that can be adjusted to accommodate for the variable distance of the piles from the dock.

SUMMARY OF THE INVENTION

A pile guide has a collar with a void therein. A planar flange extends from a side of the collar. A bracket has a first guide and a second guide forming opposing guides constructed and arranged for receiving the planar flange of the pile guide therein. The planar flange is in a slidable relationship with the bracket, and the bracket is constructed and arranged for mounting to a floating dock. The first guide and the second guide may pivot relative to the first guide and allow rotational movement of the pile guide relative to the bracket. The distance of the collar from the floating dock can be adjusted to accommodate for positioning of pile guides due to varying distances of piles from the floating dock.

BRIEF DRAWING DESCRIPTION

DETAILED DESCRIPTION OF PREFERRED EMBODIMENTS

Figure 1:
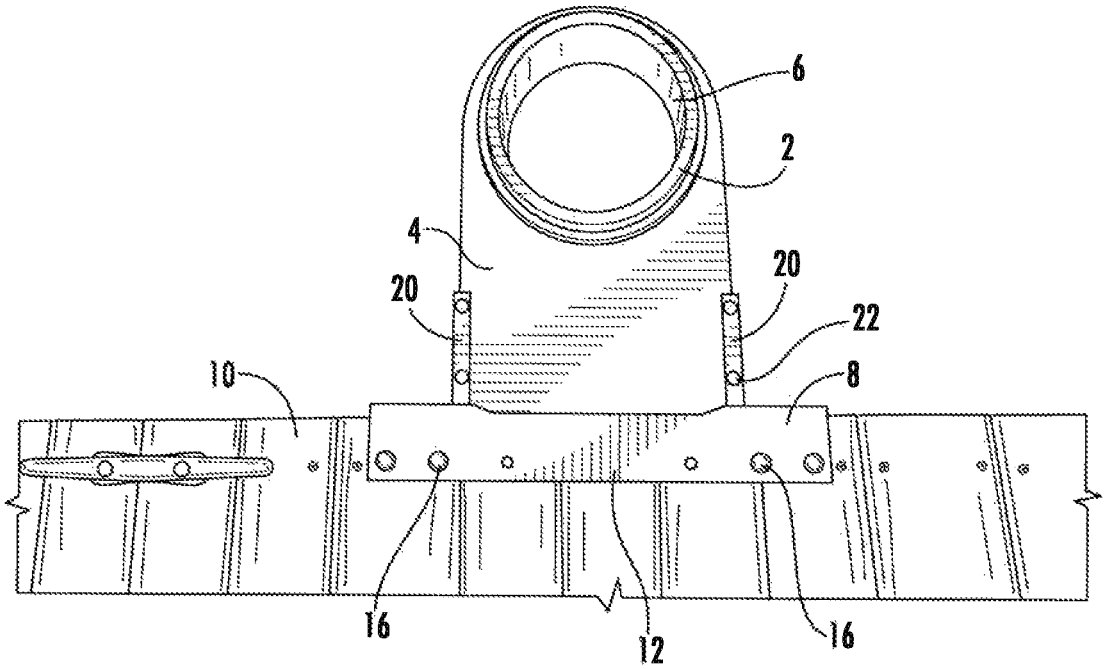
FIG. 1 is a top plan view showing a pile guide within an adjustable mounting, with the mounting bracket fixed to a boat dock.

FIG. 1 shows a pile guide 2 according to the invention. The pile guide comprises a planar flange 4. The planar flange extends from a side of a collar 6. As shown in the drawings, and in use, an axis of the void or opening of the collar extends generally vertically. The collar has an opening that is constructed and arranged to receive a pile that is driven into the earth or is otherwise positioned.

In one example of use, the pile extends upwardly from the earth and out of the top surface of the water. The pile extends through the opening in the collar of the pile guide. The pile and pile guide hold the dock in its horizontal position in the water, while usually permitting vertical movement of a floating dock.

The planar flange 4 of the pile guide is inserted into an adjustable mounting 8 according to the invention. The planar flange extends from one side of the collar 6. The planar flange minimally may have a length capable of engaging the guides 20. Generally, the planar flange will have a length that exceeds a diameter of the collar. The planar flange has a substantially flat upper surface and a substantially flat lower surface and wherein the substantially flat upper surface and the substantially flat lower surface are in the slidable relationship with the bracket.

The mounting bracket 8 is fastened, such as by the use of bolts or screws, to a dock 10 that may be formed of wood or metal. The mounting bracket may comprise a generally horizontal member 12 that meets a generally vertical member 14 at substantially a right angle so that a corner of the dock is received within the mounting bracket. Fasteners, such as bolts or screws 16 may be inserted into the generally horizontal portion of the mounting bracket. In some embodiments, bolts or screws are inserted into the vertical portion of the mounting bracket.

Figure 3:
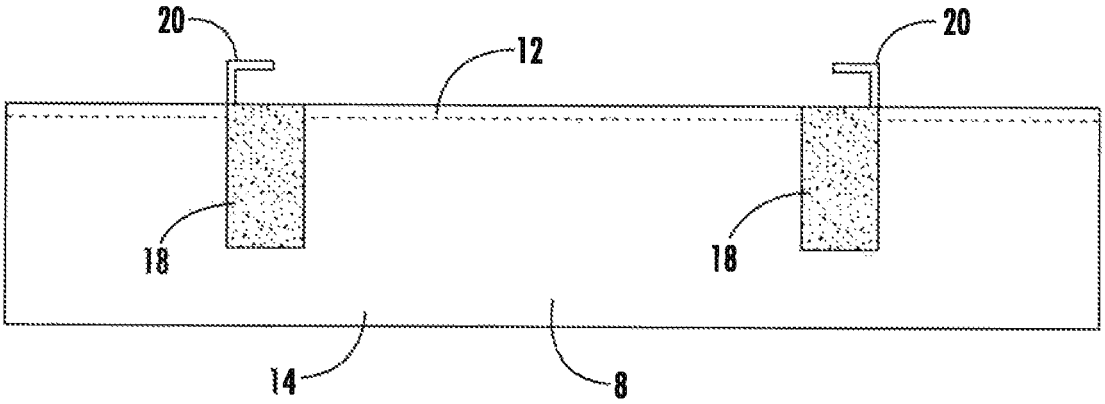
FIG. 3 is an elevation of the mounting bracket.
Figure 4:
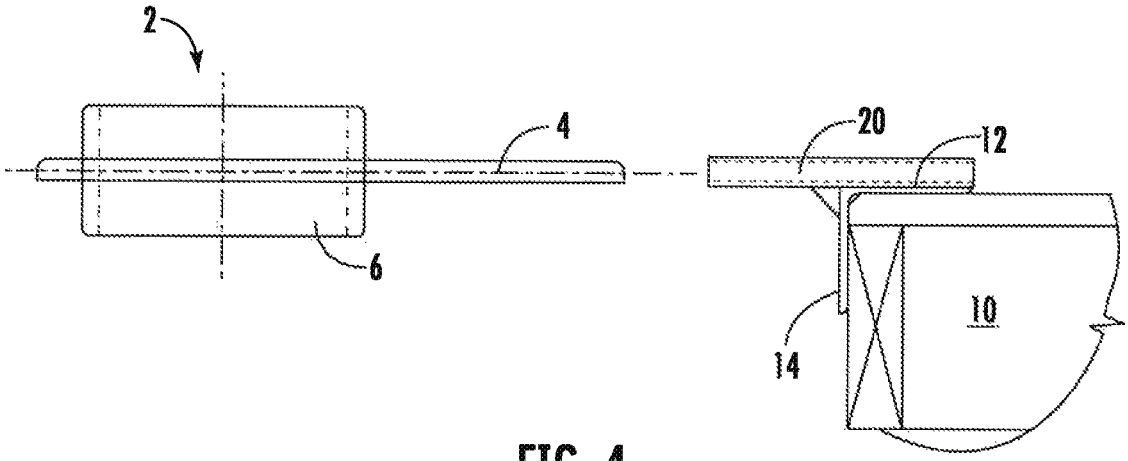
FIG. 4 is an elevation of the adjustable mounting affixed to a dock, with the pile guide exploded away from the mounting bracket.
Figure 5:
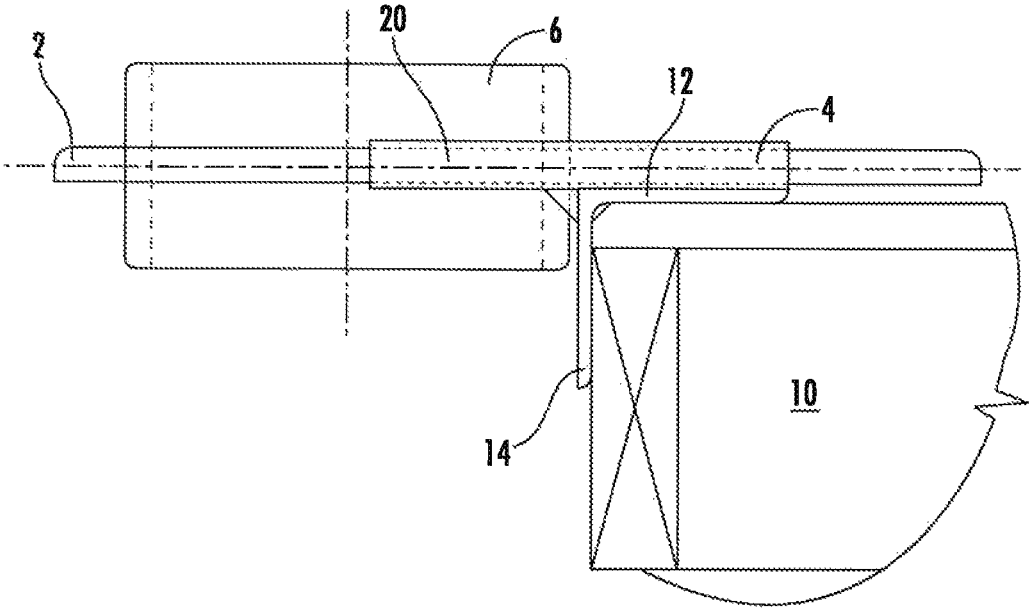
FIG. 5 is a side elevation of the adjustable mounting with the pile guide positioned within the mounting bracket.
Figure 6:
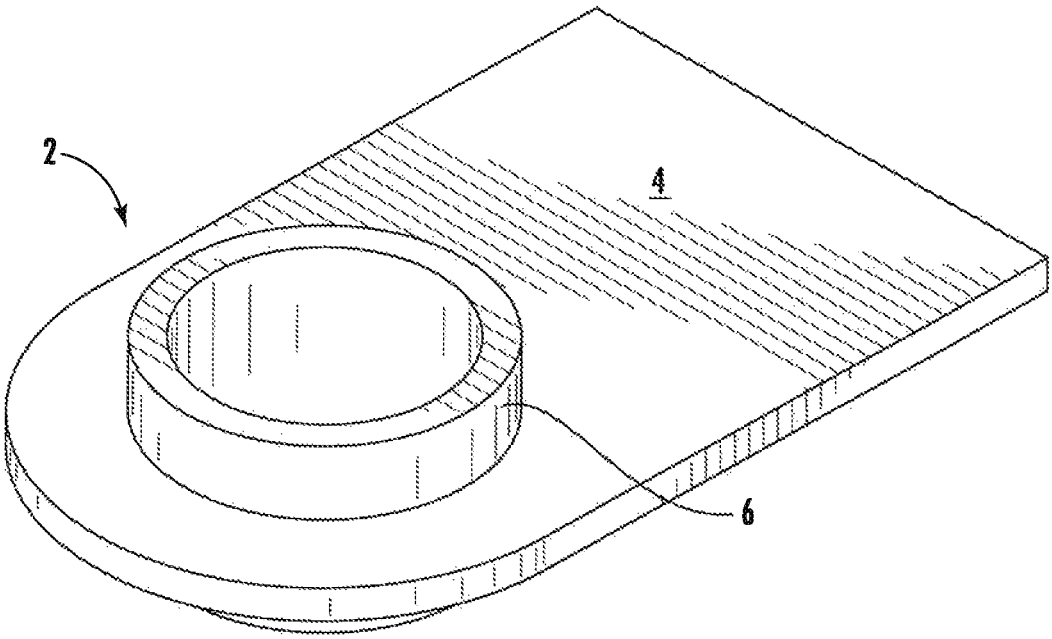
FIG. 6 is a perspective view of a pile guide useful with the invention.
Figure 7:
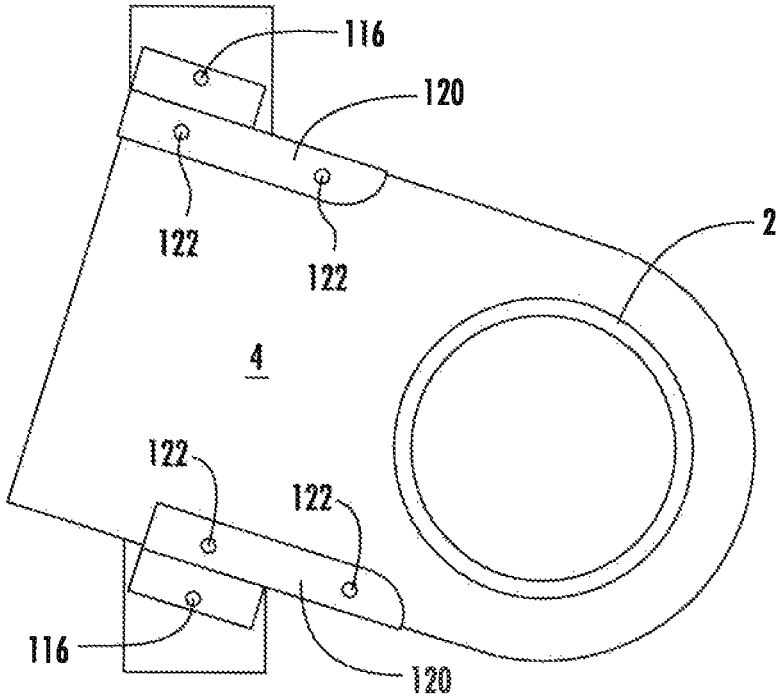
FIG. 7 is a top plan view of another embodiment of a pile guide and mounting bracket, with pivoting guides.
Figure 8:
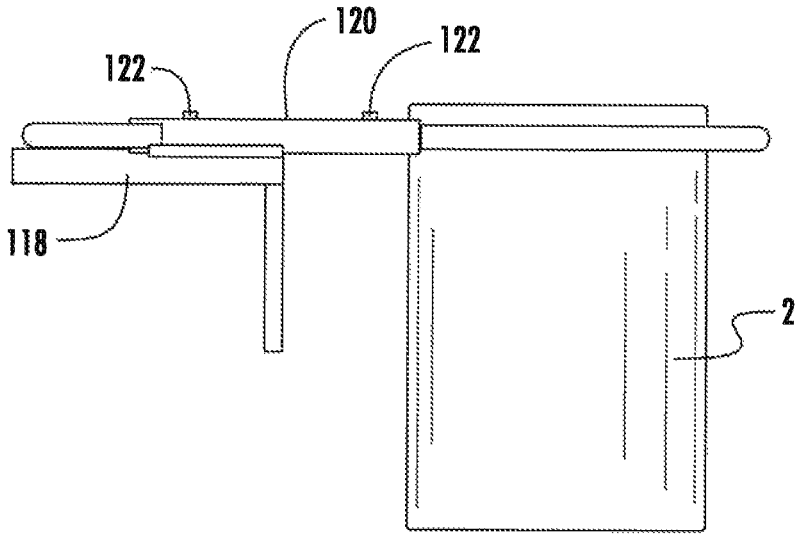
FIG. 8 is a side elevation of the pile guide and mounting bracket of FIG. 7.
Figure 9:
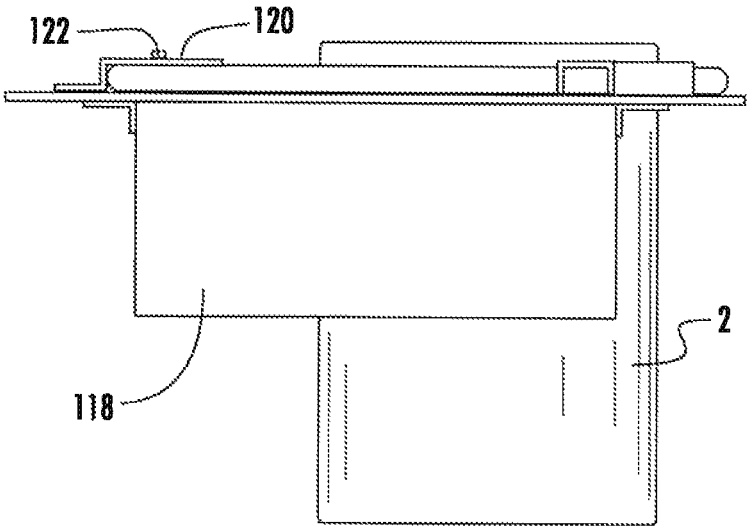
FIG. 9 is an elevation of an end of the pile guide and mounting bracket of FIG. 7.
Figure 10:
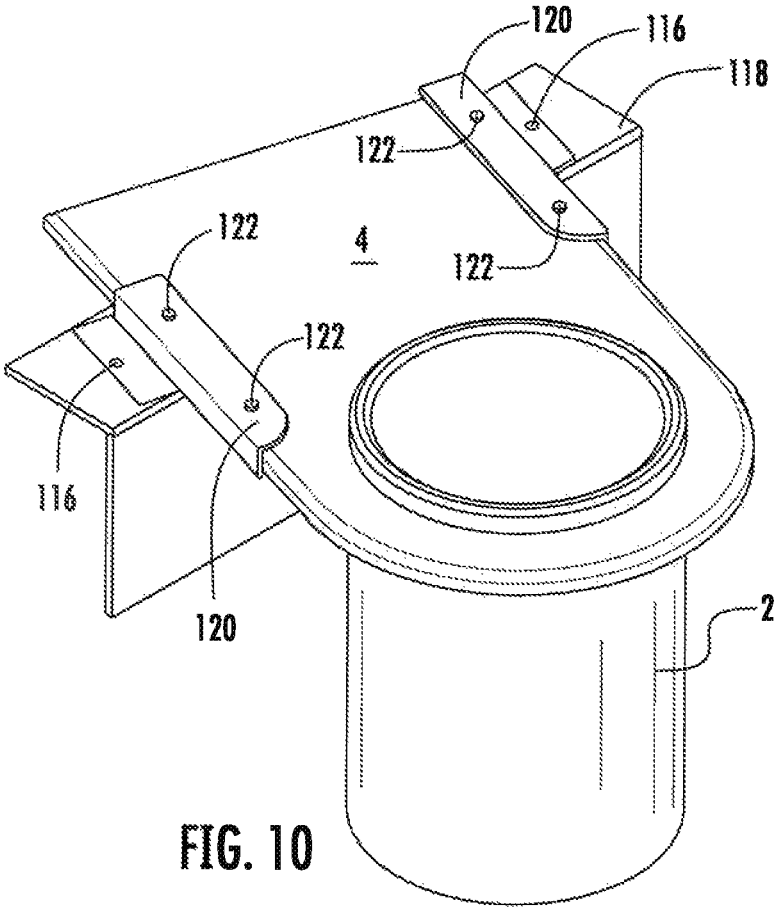
FIG. 10 is a perspective view of the pile guide and mounting bracket of FIG. 7.

In a preferred embodiment, the bracket 8 comprises a first guide and a second guide that form opposing guides 20. The opposing guides may be formed as three sided guides 20 that receive the planar flange 4 of the pile guide. The guides may be generally in the shape of a "U" that is turned on its side, as shown in the drawing figures. FIG. 3. A first guide of the bracket comprises a portion that extends generally vertically and a portion that extends generally horizontally from the vertical portion and, in use, above the portion that generally extends generally vertically, forming an opening in the first guide of the bracket. A second guide positioned on an opposing side of the bracket comprises a portion that extends generally vertically and a portion that extends generally horizontally and, in use, above the member that extends generally vertically, forming an opening in the second side of the bracket. The opening so formed by the second guide opposes the opening formed by the first guide of the bracket. The planar flange of the pile guide is slidably retained between the opening in the first guide of the bracket and the opening in the second guide of the bracket. The guides 20 are formed as part of the mounting bracket 8.

The guides 20 receive the planar flange of the pile guide between the first guide and the second guide. The planar flange 4 of the pile guide 2 slidably engages the opposing guides 20 of the mounting bracket 8. The pile guide and dock may be positioned horizontally as desired relative to each other. A dock usually has multiple piles that engage pile guides which, in turn, engage the dock. Many times, the distance from the piles to the dock is not precise. The slidable engagement of the pile guide with the mounting bracket compensates for the variation in distance of the individual piles from the dock.

Figure 2:
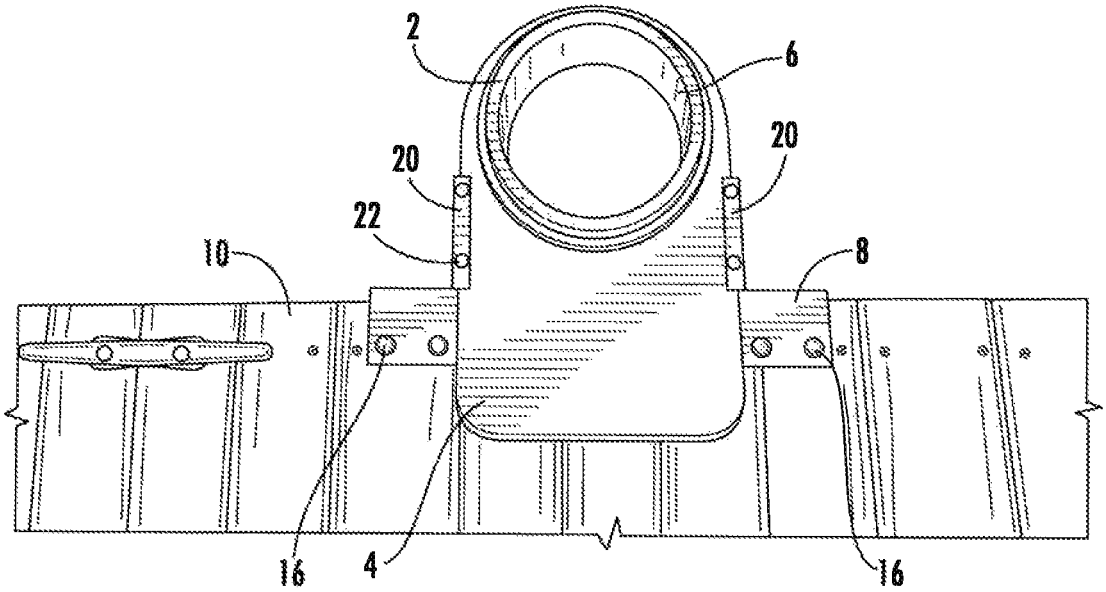
FIG. 2 is a top plan view showing a pile guide within an adjustable mounting in a different position from FIG. 1, with the mounting bracket affixed to a boat dock.

The thickness and width of the flange is selected so that it is retained within the guides 20 of the mounting bracket, but the pile guide can also slide within the guides so that the opening of the collar 6 is positioned at a desired distance from the dock 10, as demonstrated by FIGS. 1 and 2. The length of the flange is also selected so as to provide adequate adjustability for positioning the collar of the pile guide relative to the dock.

In the present invention, since the pile guide slides within the mounting bracket 8, and the distance between the piles and the dock varies from pile to pile, the variation in the distance can be accounted for by positioning the pile guide within the guides 20 as required. As shown in FIG. 1, the opening in the collar of the pile guide is further from the dock than in FIG. 2. The pile guide may then be fixed to the guides of the mounting bracket in the preferred position by bolts or screws 22.

The pile guide 2 is preferred to be formed of high density polyethylene. High density polyethylene is impact resistant, has a low coefficient of friction and permits the planar flange 4 to slide easily within the opposing brackets 20 of the mounting bracket 8. The pile guide may be formed of other impact resistant plastics, such as medium density polyethylene. The collar and the planar flange are preferred to be formed as unitary members of a single material. The mounting bracket construct 8 is preferred to be formed of aluminum or stainless steel, which are corrosion resistant in water and saltwater. High density polyethylene is also corrosion resistant.

FIGS. 7 through 13 present other embodiments of the adjustable mounting. In this embodiment, the opposing guides 120 are each pivotally mounted to the bracket 118.

FIGS. 7-13 show the pile guide 2 pivoted or rotated a few degrees from the mounting bracket. The opposing guides 120 are each connected to the mounting bracket 118, 218 by a single fastener 116 that allows pivoting or rotation of the guides relative to the bracket. The mounting bracket of FIGS. 7-11 is mounted to a dock in most applications. The planar member 4 of the pile guide is slidable within the guides 120 as described above. The pivotable mounting of the guides relative to the dock allows a few degrees of rotation of the pile guide.

As explained herein, piles are not always precisely positioned relative to each other or relative to a dock or other object. The slidable engagement of the planar member 4 of the pile guide relative to the guides 120 allows adjustability in one dimension, and the ability to rotate or pivot the guides relative to the mounting bracket 118 and dock allows adjustability in another dimension. This structure accommodates piles that are not evenly spaced or spaced as desired, without having to reposition either the dock or the piles or the mounting for the pile guide. After the pile guide is positioned within the opposing guides as desired, and the opposing guides are rotated or pivoted to the desired position to secure the dock or other object relative to the pile, the pile guide and the opposing guides are fixed in position relative to the mounting bracket with fasteners 116, 122, such as bolts or screws.

Figure 11:
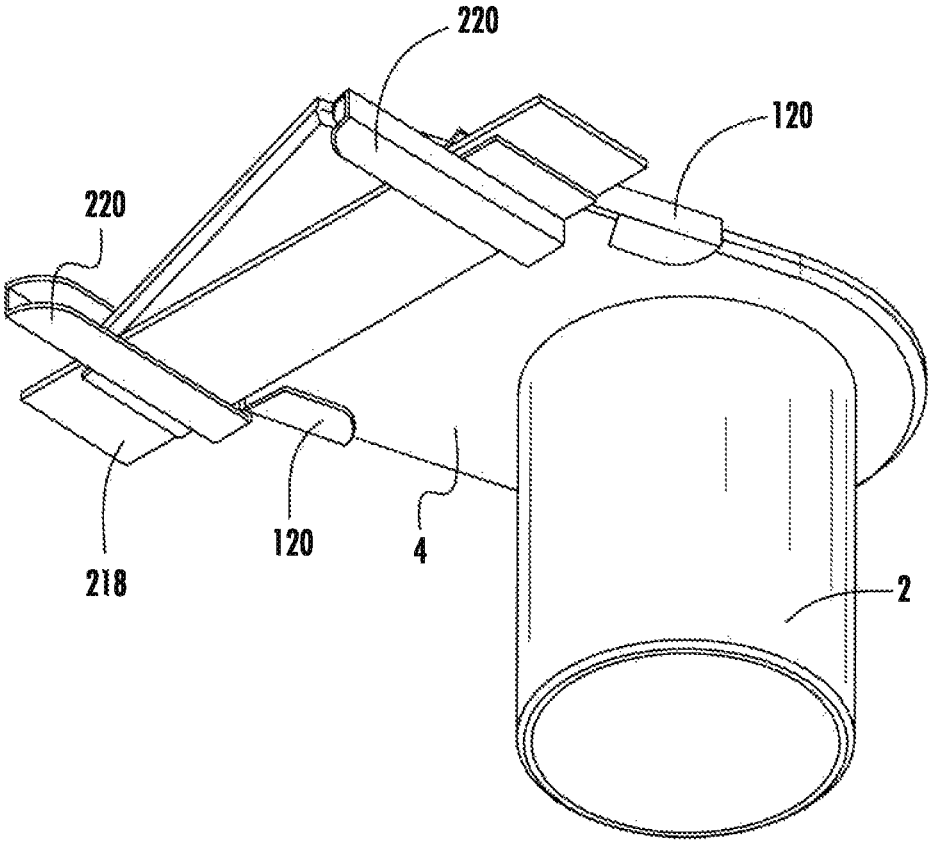
FIG. 11 is a bottom, perspective view of the pile guide and mounting bracket of an additional embodiment of the invention incorporating elements of the pile guide and mounting bracket of FIG. 7.
Figure 12:
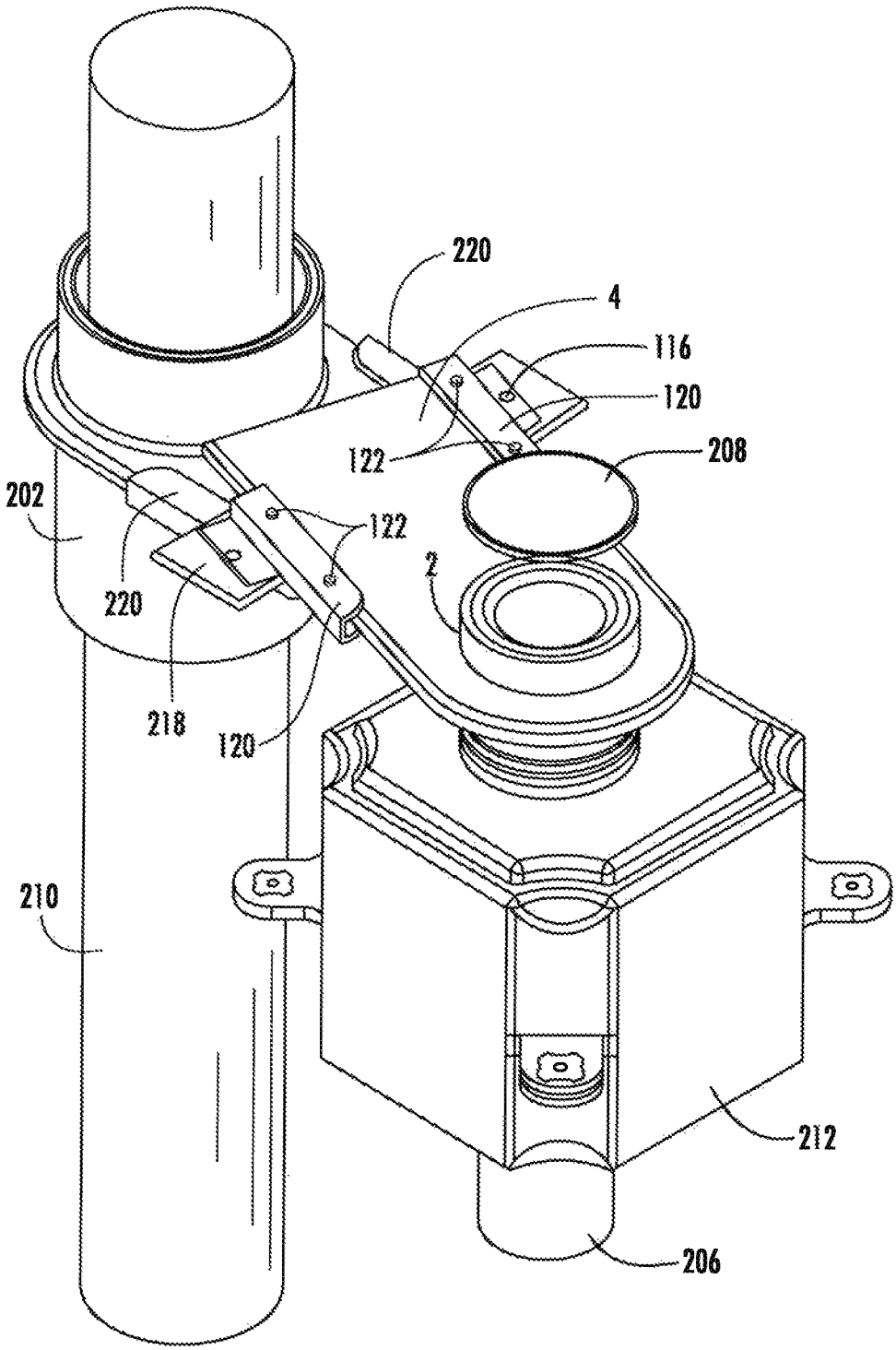
FIG. 12 is a perspective view of an application of the pile guide and mounting bracket of FIG. 11.
Figure 13:
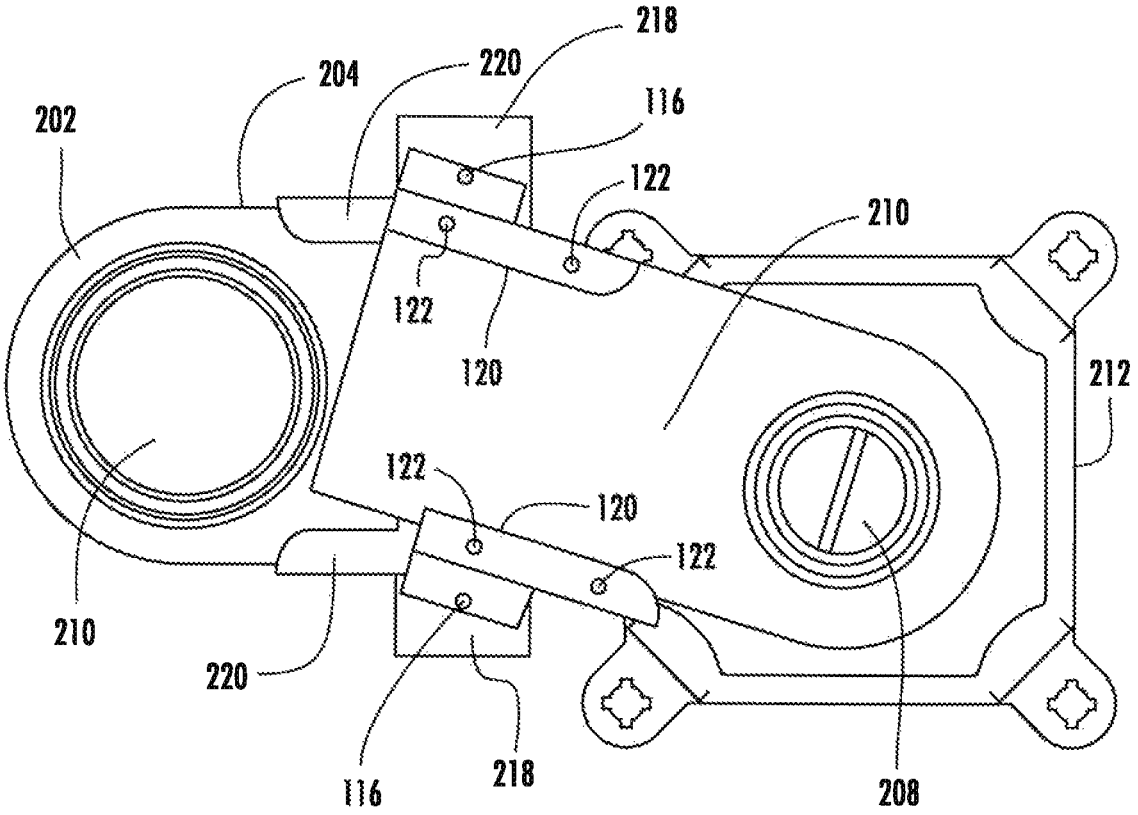
FIG. 13 is a top plan view of the application of an embodiment of the invention according to FIG. 12.

FIGS. 11-13 demonstrate an alternative application of the pile guide embodiments of the invention shown above. Two (2) pairs of opposing guides, 120, 220, are employed. Two (2) pile guides 2,202 may be used as shown in FIGS. 12 and 13. Piles 206,210 extend through or are retained by the pile guides 2,202. Pile guide 2 is slidable for adjustability relative to the opposing guides 120 as described above and FIGS. 7-10, and also pivots for adjustability by using fasteners 116 to allow pivoting during installation as described above, and then fixing the pile guide in place. The pile guide 2 may be used to secure a dock (demonstrated by 212, which is a modular cube used with some docks, although the application is not so limited) or extend through a dock. A cap 208 may be placed over the pile or pile guide.

Opposing guides 220 allow an additional pile guide 202 to be used. Additional adjustability is provided since the planar member 204 of the pile guide is slidable relative to the opposing guides 220. The guides 120,220 may be mounted to a mounting bracket 218 or other connecting structure in one embodiment.

What is claimed:

1. A pile guide construct, comprising:

a collar having a void therein, wherein an axis of the void of the collar extends vertically, a planar flange extending from a side of the collar, a bracket, a first guide and a second guide, the first guide and the second guide forming opposing guides, wherein the first guide and the second guide are in a pivoting relationship relative to the bracket, the planar flange having a length constructed to engage the opposing guides between the opposing guides, wherein the planar flange is in a slidable relationship within the opposing guides, and wherein the collar pivots as the opposing guides pivot relative to the bracket.

2. A pile guide construct for docks as described in claim 1, wherein the planar flange has a substantially flat upper surface and a substantially flat lower surface and wherein the substantially flat upper surface and the substantially flat lower surface are in the slidable relationship with the opposing guides.

3. A pile guide construct for docks as described in claim 1, wherein the first guide comprises a portion that extends generally vertically and a portion that extends generally horizontally from the portion of the first guide that extends generally vertically, and the second guide comprises a portion that extends generally vertically and a portion that extends generally horizontally from the portion of the second guide that extends generally vertically and the portion that extends horizontally from the second guide extends toward the portion that extends generally horizontally from the first guide, and the first guide and the second guide are spaced apart, wherein the planar flange is slidable relative to the first guide and the second guide for adjusting the distance of the collar from the bracket, and the planar flange is retained between the opposing guides.

4. A pile guide construct for floating docks as described in claim 1, wherein the collar extends above the planar flange and below the planar flange.

5. A pile guide construct for floating docks as described in claim 1, wherein, in use, a distance of the collar from the bracket is adjusted by sliding the planar flange within the opposing guides to a desired distance of the collar from the bracket, and the planar flange is subsequently attached to the opposing guides.

6. A pile guide construct for docks as described in claim 1, wherein the planar flange and the collar are formed as unitary members.

7. A pile guide construct for floating docks as described in claim 1, wherein the planar flange and the collar are formed of polyethylene for a pile guide.

8. A pile guide construct for docks as described in claim 1, wherein the first guide comprises a single pivot point and the second guide comprises a single pivot point and the single pivot point of the first guide and the single pivot point of the second guide are each constructed and arranged to fix the opposing guides in position relative to the bracket.

* * * * *